United States Patent [19]

Mescall et al.

[11] 4,089,267

[45] May 16, 1978

[54] HIGH FRAGMENTATION MUNITION

[75] Inventors: John F. Mescall, W. Newton; Paul V. Riffin, Lexington, both of Mass.

[73] Assignee: The United States of America as represented by the Secretary of the Army, Washington, D.C.

[21] Appl. No.: 727,912

[22] Filed: Sep. 29, 1976

[51] Int. Cl.[2] ..... F42B 13/48; F42B 27/02

[52] U.S. Cl. ..... 102/67; 102/64

[58] Field of Search ..... 102/24 R, 64, 67

[56] References Cited

U.S. PATENT DOCUMENTS

| | | | |
|---|---|---|---|
| 1,236,295 | 8/1917 | Hamilton | 102/64 |
| 3,675,577 | 6/1972 | Sternberg et al. | 102/67 |
| 3,938,441 | 2/1976 | Sewell et al. | 102/67 |
| 4,026,213 | 5/1977 | Kempton | 102/67 |

*Primary Examiner*—Verlin R. Pendegrass

*Attorney, Agent, or Firm*—Nathan Edelberg; Robert P. Gibson; Lawrence E. Labadini

[57] ABSTRACT

A high fragmentation munition such as an artillery shell, bomb, hand grenade, and the like, wherein a casing containing a high explosive is positioned within and spaced from the inner wall of an outer casing whereby, upon detonation, the high explosive accelerates the inner casing across the space to the outer casing to make a mechanical impact therewith to thereby produce a high fragmentation effect.

3 Claims, 10 Drawing Figures

HIGH FRAGMENTATION MUNITION

The Invention described herein may be manufactured and used by or for the Government for governmental purposes without the payment of any Royalties thereon or therefore.

BACKGROUND OF THE INVENTION

In conventional munitions wherein an explosive is contained within a casing, the detonation of the explosive transmits a shock wave into the casing to create a region of intense pressure therein, to thereby expand the casing to effect the fragmentation thereof.

After considerable research and experimentation, the munition of the present invention has been devised to increase the fragmentation of conventional munitions by introducing a mode of fracture called "spallation" produced by imparting a tensile radial stress in the munition casing. This spallation is effected by providing a casing, referred to as a "slapper", containing a high explosive, within and spaced from the inner wall of the outer or munition casing, whereby, upon detonation, the high explosive propels or accelerates the slapper across the space to the outer casing to make a mechanical impact therewith, whereby a more intense stress state is imparted to the outer casing, to thereby produce a larger number of fragments from a given outer casing.

DESCRIPTION OF THE PREFERRED EMBODIMENTS

Figure 1A:
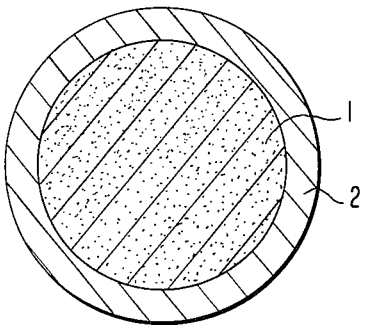
FIG. 1a (PRIOR ART)
FIG. 1*a* is a cross-sectional view of a conventional munition.
Figure 1B:
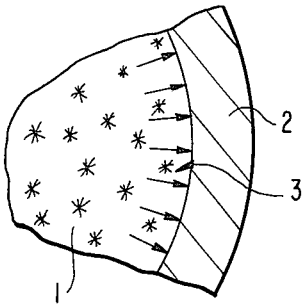
FIG. 1b (PRIOR ART)
FIGS. 1*b* to 1*e* are enlarged, fragmentary, cross-sectional views of the munition shown in FIG. 1*a* showing, sequentially, the fragmentation process in conventional munitions.
Figure 1C:
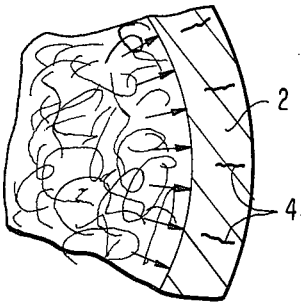
FIG. 1c (PRIOR ART)
Figure 1D:
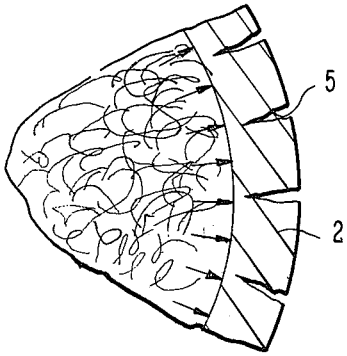
FIG. 1d (PRIOR ART)
Figure 1E:
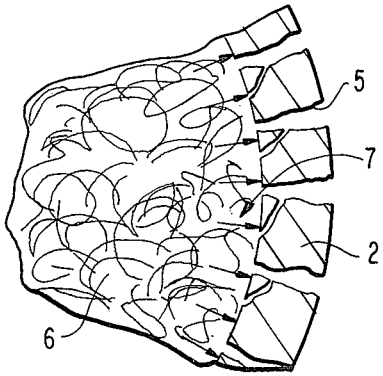
FIG. 1e (PRIOR ART)

Referring to FIG. 1*a*, a conventional munition is shown which includes a high explosive 1 contained within a casing 2. Detonation of the high explosive 1, FIG. 1*b*, creates a region 3 of intense pressure within the casing which is only gradually relieved by the outward radial expansion of the casing. It has been determined that the radial stress remains compressive throughout the event, and that the circumferential or hoop stress becomes tensile and produces fractures 4, FIG. 1*c*, near the outer surface of the casing. Breakup of the casing 2 thus begins with radial cracks 5, FIG. 1*d*, which propagate toward the outer surface of the casing 2 and the inner surface thereof, FIG. 1*e*. The progress of the radial cracks 5 toward the inner surface of the casing 2 is, however, inhibited by the pressure of the explosive gas 6 which maintains an overall compressive stress state 7 near the inner surface. Eventually the shear stress reaches a critical level and a shear mode of fracture near the inner surface of the casing completes the fragmentation process.

The above-described fragmentation process for a conventional munition or round has been confirmed by both dynamic and static tests which also revealed the total absence of a third mode of fracture called "spallation"; that is, circumferential cracks produced by the stress in the radial direction.

Figure 2A:
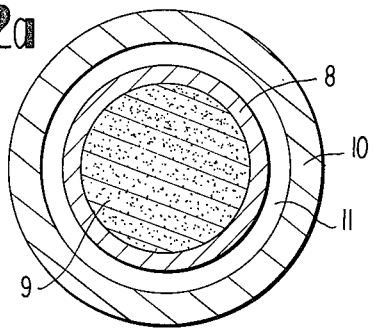
FIG. 2*a* is a cross-sectional view of the munition of the present invention.

The munition of the present invention has been devised to induce the spallation mode of fracture and to thereby substantially increase the number of fragments thus formed. As will be seen in FIG. 2*a*, the munition of the present invention comprises a casing 8, called a "slapper", which contains a high explosive 9. The slapper 8 is positioned within and spaced from the inner wall of the outer casing 10. While not shown, it is contemplated that the slapper 8 will be held in spaced relationship from the inner wall of the outer casing by providing the space or void 11 with suitable support members; such as, low density foam, honeycomb, or the like.

Figure 2B:
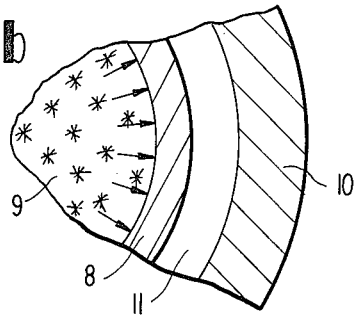
FIGS. 2*b* to 2*e* are enlarged, fragmentary, cross-sectional views of the munition of FIG. 2*a* showing, sequentially, the fragmentation process in the munition of the present invention.
Figure 2C:
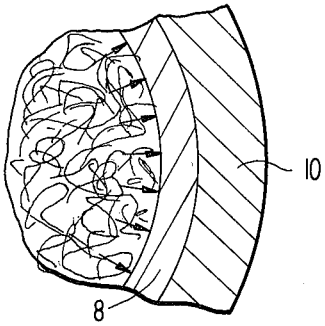
Figure 2D:
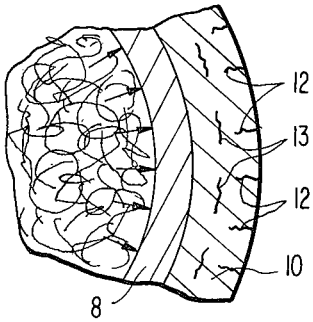
Figure 2E:
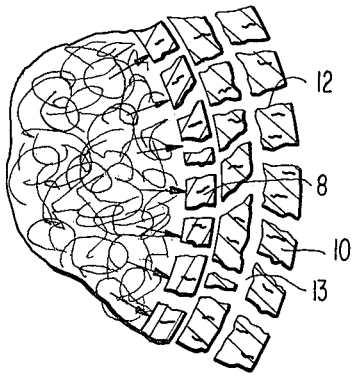

Upon detonation, the high explosive 9, FIG. 2*b*, propels or accelerates the slapper 8 across the void or space 11 to make a mechanical impact with the outer casing 10, FIG. 2*c*. The employment of this mechanical impact, rather than the expansion of the explosive products, to induce the required stresses in the outer casing, results in a much higher stress state in the outer casing due to the higher impedance of the slapper, and the thickness of the slapper controls the duration of the impact, thus the tendency of the radial stress to remain compressive is suppressed, thereby producing a new fracture pattern which includes not only the conventional tensile and shear cracks illustrated in FIGS. 1*c* to 1*e* (also illustrated as 12 in FIGS. 2*d* and 2*e*), but also the new pattern of spallation as shown in FIGS. 2*d* and 2*e* wherein the radial stresses produced in the outer casing result in spall fractures 13 progressing circumferentially around the outer casing approximately ¼ to ½ the distance from the outer surface to the inner surface of the outer casing. The result is a significantly larger number of fragments, as shown in FIG. 2*e*, as compared to the conventional munition, illustrated in FIG. 1*e*.

The spallation mode of fracture is attributable to the use of the slapper 8, the employment of the void or space 11, and the thickness of the slapper. The space 11 permits the acceleration or build-up of velocity by the slapper 8 before impact, which, in turn, regulates the intensity of the shock wave. If no void or space is present, for example, a two-walled cylinder with a tight fit, the resulting stress state will not produce spallation. Since spallation depends upon both the amplitude and duration of the shock, the thickness of the slapper controls the duration of the shock pulse, and for a given amount of high explosive a thicker slapper will have greater mass, consequently less velocity at impact time, and, therefore, will induce a less intense shock in the casing.

It will be appreciated by those skilled in the art that various modifications in the thickness and types of material can be made in the slapper and outer casing to obtain the optimum of fragmentation; however, good results have been obtained when the slapper thickness and void distance should each equal one-half the thickness of the outer casing. The selection of the material used in the slapper will depend upon the desired high shock impedance values and low impact velocity associated with high density material, and its relation to the material used in the outer casing; that is, high fragmentation steel for enhanced fragment breakup.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A high fragmentation munition consisting of a slapper, a high explosive contained within said slapper, said slapper being positioned within and uniformly spaced from the wall of an outer casing, the thickness of said slapper and the radial distance of the space between the outer wall of the slapper and the inner wall of the outer casing are each equal to one-half the thickness of the outer casing, whereby upon detonation, the high explosive propels the slapper across the space to the outer casing to make a mechanical impact therewith, thereby imparting circumferential and radial stresses to the outer casing resulting in a spallatial mode of fracture.

2. A high fragmentation munition according to claim 1 wherein the slapper comprises a casing.

3. The method of producing the spallation mode of fracture in a high fragmentation munition upon detonation which consists of (a) enclosing a high explosive material within a cylindrical slapper, which slapper is uniformly spaced from the inner surface of an outer cylindrical steel casing by a void, said slapper thickness and the void distance each equaling one-half the thickness of the outer casing, and (b) detonating the high explosive material to cause said slapper to accelerate across said void to mechanically impact on said casing, producing a stress state in said casing which results in spall fractures in addition to conventional shear and tensile cracks in said casing.

* * * * *